US008037643B1

(12) United States Patent
Anderson

(10) Patent No.: US 8,037,643 B1
(45) Date of Patent: Oct. 18, 2011

(54) ROOF RIDGE CONSTRUCTION APPARATUS AND METHOD

(76) Inventor: Terry E. Anderson, Highland, UT (US)

( * ) Notice: Subject to any disclaimer, the term of this patent is extended or adjusted under 35 U.S.C. 154(b) by 1170 days.

(21) Appl. No.: 11/683,974

(22) Filed: Mar. 8, 2007

Related U.S. Application Data

(60) Continuation-in-part of application No. 10/973,195, filed on Oct. 26, 2004, now abandoned, which is a division of application No. 10/283,007, filed on Oct. 29, 2002, now abandoned.

(60) Provisional application No. 60/394,351, filed on Jul. 8, 2002.

(51) Int. Cl.
*E04D 13/12* (2006.01)
*E04D 13/00* (2006.01)

(52) U.S. Cl. ..... 52/57; 52/42; 52/711; 52/701; 248/237; 182/45

(58) Field of Classification Search ..... 403/232.1; 52/57, 41, 42, 43, 370, 701, 702, 708, 711, 52/712, 714; 182/45, 224, 153; 248/237
See application file for complete search history.

(56) References Cited

U.S. PATENT DOCUMENTS

| | | | | |
|---|---|---|---|---|
| 533,659 | A | 2/1895 | Meyenberg | |
| 828,488 | A | 8/1906 | Lanz | |
| 1,015,191 | A | 1/1912 | Kneisley | |
| 1,077,631 | A | 11/1913 | Mohun | |
| 1,093,201 | A | 4/1914 | Owen | |
| 1,203,148 | A | 10/1916 | Slatten | |
| 1,218,211 | A | 3/1917 | Rowe | |
| 1,423,939 | A | 7/1922 | Jester | |
| 1,780,579 | A | 11/1930 | Crowley | |
| 1,996,761 | A | 4/1935 | Gould et al. | |
| 2,191,979 | A * | 2/1940 | Bierbach | 52/370 |
| 2,628,796 | A | 2/1953 | Krizman | |
| 2,990,037 | A * | 6/1961 | Fowles | 52/238.1 |

(Continued)

FOREIGN PATENT DOCUMENTS

DE 3525164 1/1987

(Continued)

OTHER PUBLICATIONS

"Concrete and Clay Tile Roof Design Criteria Manual for Cold and Snow Regions," *National Tile Roofing Manufacturers' Association and the Western States Roofing Contractors Association*, Leelan E. Gillen P.E. and Terry Anderson, pp. 6-16-6-17, 1998.

(Continued)

*Primary Examiner* — Phi Dieu Tran A
(74) *Attorney, Agent, or Firm* — Austin Rapp & Hardman

(57) ABSTRACT

An apparatus and method for roof ridge construction are provided. Ridge risers are used to securely retain an attachment block above sheathing portions at an elevation sufficient to permit air venting through the ridge. The ridge risers have legs with one or more weakened regions (such as scores) that permit easy folding so that the legs can be attached to the sheathing and/or rafter portions. A set of attachment holes may be positioned below each of the weakened regions. The legs are joined to a cradle in which the attachment block rests. The attachment block is retained within the cradle via a mechanism such as fasteners, retention cleats, and retention assemblies with tabs designed to be driven into the attachment block. Roof covering elements, such as shingles, shakes, tiles, slate units, metal units, and synthetic ridge covering elements, are attached to the roofing block.

21 Claims, 8 Drawing Sheets

U.S. PATENT DOCUMENTS

| | | | | | |
|---|---|---|---|---|---|
| 3,256,030 | A | | 6/1966 | Banse | |
| 3,423,898 | A | | 1/1969 | Coloney et al. | |
| 4,022,537 | A | | 5/1977 | Gilb et al. | |
| 4,073,108 | A | * | 2/1978 | Williams | 52/238.1 |
| 4,249,713 | A | | 2/1981 | Glynn et al. | |
| 4,270,330 | A | * | 6/1981 | Townsend | 52/712 |
| 4,669,235 | A | * | 6/1987 | Reinen | 52/98 |
| 4,788,801 | A | * | 12/1988 | Jones | 52/57 |
| 4,995,209 | A | * | 2/1991 | Cobb | 52/238.1 |
| 5,101,932 | A | | 4/1992 | Trudgeon | |
| 5,248,021 | A | | 9/1993 | Nichols | |
| 5,287,944 | A | | 2/1994 | Woodyard | |
| 5,326,318 | A | | 7/1994 | Rotter | |
| 5,448,871 | A | * | 9/1995 | Newman et al. | 52/712 |
| 5,593,348 | A | | 1/1997 | Rickert | |
| 5,595,260 | A | | 1/1997 | Jalla | |
| 5,713,158 | A | | 2/1998 | Gibbs | |
| 5,738,581 | A | | 4/1998 | Rickert et al. | |
| 5,740,634 | A | | 4/1998 | Schade | |
| 5,896,719 | A | | 4/1999 | Thornton | |
| 6,015,343 | A | | 1/2000 | Castillo et al. | |
| 6,022,165 | A | | 2/2000 | Lin | |
| 6,295,780 | B1 | * | 10/2001 | Thompson | 52/712 |
| 6,640,516 | B1 | | 11/2003 | Thompson | |
| 2002/0072324 | A1 | | 6/2002 | Strait | |

FOREIGN PATENT DOCUMENTS

| | | |
|---|---|---|
| DE | 3933037 | 10/1989 |
| DE | 4210497 | 3/1992 |
| EP | 369508 | 5/1990 |
| JP | 11270061 | 10/1999 |

OTHER PUBLICATIONS

"Ridge tree bracket with knock in screw," Mage Herzberg GmbH website (http://mage-herzberg.de/produkte/dach/first_u_g/fge.html), May 7, 2007, p. 1-3.

"Ridge batten bracket," Mage Herzberg GmbH, (We believe the publication date is Apr. 14, 2007 but we are not certain of this), p. 1-2.

"Justy," Mage Herzberg website (http://mage-herzberg.de/produkte/dach/first_u_g/ju.html), May 7, 2007, p. 1-3.

"First-und Gratlattenhalter universal, hohenverstellbar," Mage Herzberg website (http://mage-herzberg.de/produkte/dach/first_u_g/fgu.html), May 7, 2007, p. 1.

"First-und Gratnagel," Mage Herzberg website (http://mage-herzberg.de/produkte/dach/first_u_g/fg.html), May 7, 2007, p. 1-2.

"First-und Gratlattenhalter universal," Mage Herzberg website (http://mage-herzberg.de/produkte/dach/first_u_g/fgh.html), May 7, 2007, p. 1-2.

* cited by examiner

ROOF RIDGE CONSTRUCTION APPARATUS AND METHOD

CROSS-REFERENCE TO RELATED APPLICATIONS

This application is a continuation-in-part application of U.S. application Ser. No. 10/973,195, filed Oct. 26, 2004, which is a divisional application of U.S. application Ser. No. 10/283,007, filed Oct. 29, 2002, which claims the benefit of U.S. Provisional Application No. 60/394,351, filed Jul. 8, 2002 and entitled ROOF RIDGE CONSTRUCTION APPARATUS AND METHOD. All of these prior patent applications are expressly incorporated herein by reference.

BACKGROUND OF THE INVENTION

The present invention relates to roofing systems and methods. More specifically, the present invention relates to an apparatus and method for providing ventilated roof ridge support and superior attachment of a nailer board for securing ridge and hip trim units.

The roof of a home or other building is essential for protecting the interior against the effects of precipitation, heat, and cold. Many types of roof-covering elements, including shingles, shakes, tiles, slate, metal, and synthetic substitutes, are currently used for roofing. Typically, one type of roofing unit will be applied to sloping sides of the roof while the apex of the roof, or the "ridge," receives units that are specially configured to cover the ridge. According to known methods, the ridge-covering elements are typically supported by elongated wooden blocks attached directly to the sloping sides of the roof.

Unfortunately, such a ridge configuration has a number of inherent disadvantages. One disadvantage is that the attachment is unreliable. The wooden blocks are typically nailed or otherwise attached to the edges of the substrate, or "sheathing," of the roof, which is typically constructed of plywood or some other laminated wood-based product. Attachment to the edges of the sheathing is difficult because the nail or other fastening device must be inserted through the wooden block with some precision to properly anchor within the comparatively narrow edge of the sheathing. Hence, the wooden blocks are often inadequately attached to the remainder of the roof, and are therefore easily removed, together with their attached ridge-covering elements, in the event of a windstorm, high wind, hurricane, or other trauma.

Additionally, such a ridge configuration does not generally provide adequate venting for the roof. Radiant heat and warm air from within the building will rise, and will often enter the attic area despite the presence of vapor barriers underneath the attic space. The humid air will often condense against the roof, particularly in cold weather. The resulting moisture tends to cause decay of the building envelope, thereby shortening the life of the roof and building structure and producing potentially dangerous weakened regions of the roof and structure.

Furthermore, if no venting is used, a significant temperature gradient may exist in the roof. For example, the eaves of the roof may not receive as much radiant heat from the interior of the building; hence, the eaves may be colder in cool weather. If the upper portion of the roof is warmer, snow on the upper portion may melt, slide down to the eave, and freeze again. The result is the formation of what is known as an "ice dam," which retains runoff from the upper portion of the roof.

The standing water on the roof is unable to drain from the eaves, and therefore may seep into the roof and damage the roof or the building envelope.

Although foam or fiber webbing may be used to elevate the ridge covering elements to permit venting, such materials tend to compress, for example, if a person steps on the ridge. Additionally, such materials provide little structural support for the ridge roofing units.

Furthermore, known ridge configurations generally do not provide a simple method of aligning abutting ends of adjacent wooden blocks with each other. A typical roof ridge requires the use of multiple wooden blocks, which are generally aligned end-to-end by hand in an attempt to provide a straight ridge.

Further, a safety line is often attached to the roof ridge to support a person working on the roof. However, to permit attachment of a safety line, known roof ridge configurations generally require the attachment of a specialized anchoring structure. Attachment of such an anchoring structure adds to the construction time and cost of the roof. It may even be necessary to have multiple anchoring structures distributed along the length of the ridge so that a safety line can be disposed at any desired location on the roof.

Accordingly, a need exists for a roof ridge configuration capable of remedying the problems of the prior art. Such a configuration should preferably provide sturdy support for the ridge covering elements, in a manner that allows for easy and reliable installation of the ridge covering elements. Furthermore, such a configuration should provide for air venting through the ridge to prevent moisture from damaging the substrate or building envelope and to prevent the formation of ice dams over the eaves of the roof.

Preferably, such a ridge configuration is not readily compressible, for example, by a person stepping on the ridge. A need further exists for roof ridge elements capable of aligning ends of adjoining wooden blocks. Yet further, a need exists for roof ridge elements capable of supporting the weight of a person via a safety line without requiring the use of additional anchoring structures. Such a ridge configuration should be obtained through the use of an apparatus and method that is economical, versatile, easy to manufacture, and easy to install.

BRIEF SUMMARY OF THE INVENTION

The apparatus of the present invention has been developed in response to the present state of the art, and in particular, in response to the problems and needs in the art that have not yet been fully solved by currently available roof ridge construction systems. Thus, one purpose of the present invention is to provide a roof ridge construction apparatus and method that remedies the shortcomings of the prior art.

To achieve the foregoing objective, and in accordance with the invention as embodied and broadly described herein, a ridge riser is provided. The ridge riser may be incorporated into a roof that has two or more pieces (i.e., portions) of sheathing that approach each other to form a ridge, and an underlayment portion disposed on top of each sheathing portion. A plurality of ridge risers is used to raise an attachment block above the sheathing portions so that ridge-covering elements (i.e., shingles, shakes, tiles, slate units, metal units, synthetic units, etc.) can be attached to the attachment block. The ridge risers provide for secure fixation of the attachment block to the sheathing portions and/or rafters disposed underneath the sheathing at an elevation sufficient to allow air venting through the ridge.

According to one configuration, the ridge riser comprises a pair of legs, each of which is configured to attach to one of the sheathing portions and/or an associated rafter. The legs converge to form a cradle shape to hold the attachment block. The cradle has a floor, upon which the attachment block rests, and a pair of side walls that keep the attachment block from sliding laterally off of the cradle.

Each of the legs is attached to the corresponding sheathing portion and/or rafter through the use of a plurality of substrate attachment holes. Fasteners, such as screws or nails, may be inserted through the holes and the sheathing portions to attach each leg to its corresponding sheathing portion and/or rafter. Additionally, each of the legs has a block attachment hole, through which a fastener can be inserted to fix the attachment block firmly in place within the cradle.

The ridge risers are easily usable with a wide variety of roof configurations. Each leg has a plurality of scores that permit relatively easy bending of the leg at a variety of positions along the leg. Thus, the ridge risers can be used with sheathing portions disposed at a wide variety of angles, or "slopes," and the ridge risers can also be adapted to provide the desired elevation of the attachment block. Each ridge riser can thus be used with a variety of roof covering elements and ventilation schemes.

The ridge riser may be made from one strip of steel through the use of comparatively simple stamping operations. According to one manufacturing method, the strip is cut to the appropriate length from a roll. The various holes and/or scores may be formed by a stamping process that simultaneously cuts the steel. Then, another stamping operation may be used to form the legs of the ridge riser. Yet another stamping operation may be used to provide the cradle, including the floor and side walls, to complete fabrication of the ridge riser.

According to one alternative embodiment, the block attachment holes and corresponding fasteners are eliminated in favor of a more rapid attachment block retention system. A plurality of retention members, in the form of cleats, are formed in the side walls. The cleats have points that are angled downward and generally inward, with respect to the cradle. When the attachment block is inserted into the cradle, the cleats dig into the sides of the attachment block to prevent withdrawal of the attachment block from the cradle. No fasteners need be used to anchor the attachment block within the cradle.

According to another alternative embodiment, the block attachment holes and corresponding fasteners are again eliminated in favor of a different type of retention member. A retention member is formed in each of the side walls and in each corresponding upper leg portion. The retention members are disposed within slots so that the retention members are able to move toward the interior of the cradle. Each retention member has a shank that extends upward from the corresponding upper leg portion, and terminates in a locking tab. The locking tabs are oriented inward, toward the interior of the cradle.

The locking tabs do not interfere with insertion of the attachment block into the cradle. Once the attachment block is in place, the locking tabs may be forced inward, into the attachment block. For example, the roofer may hit each shank with a hammer to drive the locking tabs into the attachment block, thereby retaining the attachment block without separate fasteners.

In another alternative embodiment, the ridge risers may also be adapted for use with supplemental venting systems. For example, in a double battening system, latticed vertical and horizontal battens are used to permit venting of the roof between the underlayment and the roof covering elements. The double battening system elevates the roof covering elements from the sheathing and underlayment, thereby requiring that the ridge covering elements be correspondingly elevated. Hence, the legs of the ridge riser may have additional length to provide the increased elevation. One or more additional scores may also be provided so that the ridge riser can be used with a double batten system, or with a conventional roof system that has only horizontal battens.

In another alternative embodiment, a ridge riser is designed to provide a junction between two adjoining attachment blocks. The ridge riser has a comparatively large longitudinal width so that the ends of two attachment blocks can easily be retained head-to-head in the cradle. Each side wall of the cradle has at least one block attachment hole. The block attachment holes are longitudinally offset from each other so that a fastener inserted through one attachment hole will engage an end of a first attachment block, while a fastener inserted through an opposing attachment hole engages an end of a second attachment block. Thus, a straight and sturdy ridge is formed.

According to another alternative embodiment, a ridge riser is designed to act as an anchor for a safety line. The ridge riser is constructed of somewhat thicker metal so that the ridge riser is able to support the weight of a person. A restraint assembly may be easily attached to the ridge riser by attaching a clip of the restraint assembly to a leg of the ridge riser. A safety harness is attached to the clip via a safety line so that a person can wear the harness and safely work on the roof.

According to yet another alternative embodiment, the ridge riser is constructed of metal with a smaller thickness, with at least one leg doubled over itself to provide reinforcement. Thus, the clip may be attached to the reinforced leg to bear the weight of a person with the restraint assembly described above.

According to a further embodiment, the ridge riser has multiple weakened regions and a set of attachment holes that are positioned below each of the weakened regions. Such positioning of the attachment holes proximate the weakened regions may provide added strength and prevent a wind surge from lifting an attached roof off of the building. In some embodiments, the weakened regions may be scores, notches, or other elements.

According to a further embodiment, the cradle of the ridge riser is either a U-shaped or an inverted U-shaped element. In those embodiments in which an inverted U-shape is used, the floor of the cradle will go over the attachment block.

These and other features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof, which are illustrated in the appended drawings. Understanding that these drawings depict only typical embodiments of the invention and are not, therefore, to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following, more detailed description of the embodiments of the apparatus, system, and method of the present invention, as represented in the Figures, is not intended to limit the scope of the invention, as claimed, but is merely representative of presently preferred embodiments of the invention.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The phrase "attached directly to" refers to a form of attachment by which the attached items are either in direct contact, or are only separated by a single fastener, adhesive, or other attachment mechanism. The term "abutting" refers to items that are in direct physical contact with each other, although the items may not be attached together. The phrase "integrally formed" refers to a body that is manufactured integrally, i.e., as a single piece, without requiring the assembly of multiple pieces. Multiple parts may be integrally formed with each other if they are formed from a single workpiece.

Figure 1:
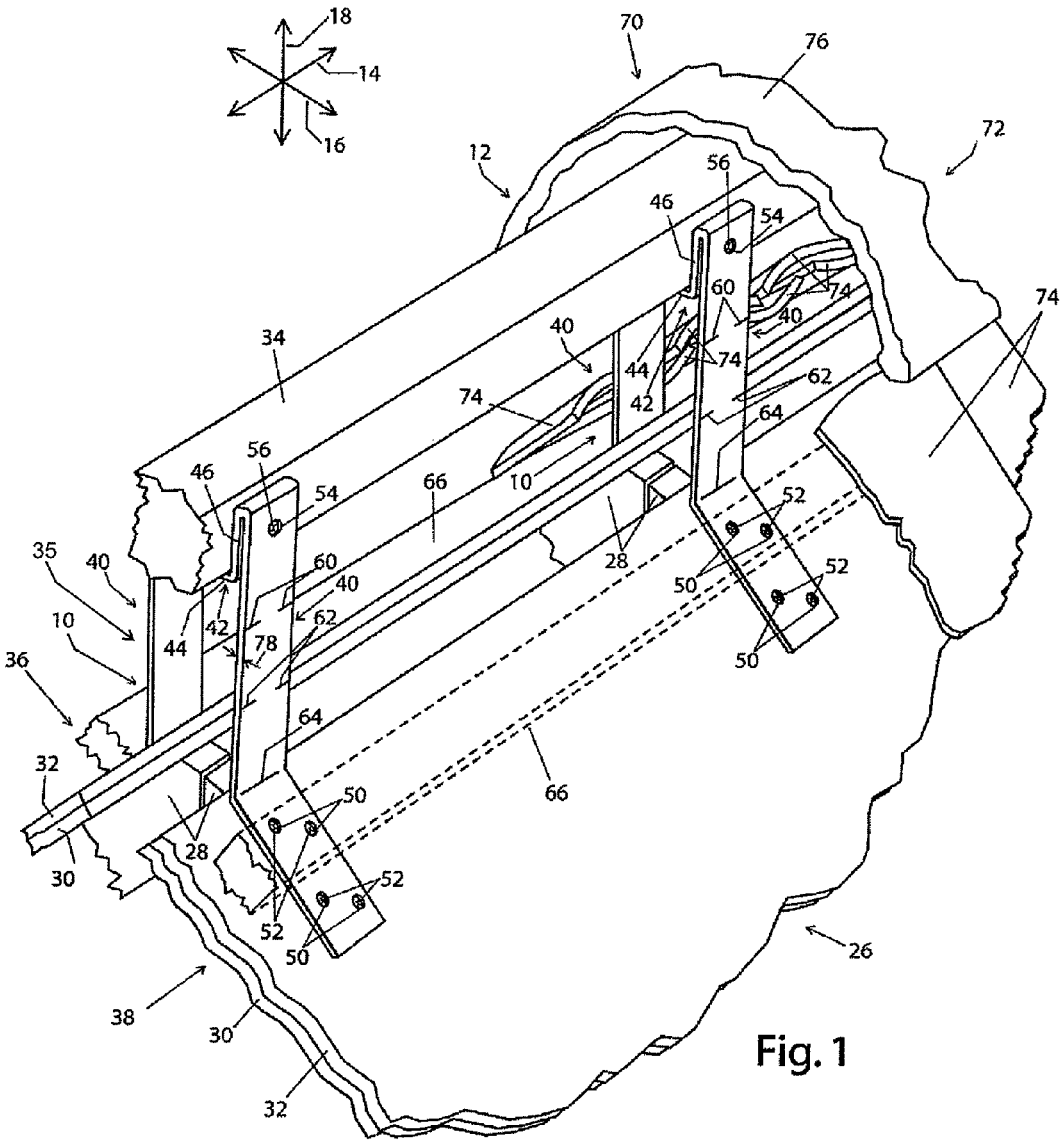
FIG. 1 is a cutaway, perspective view of a portion of a roof that incorporates ridge risers according to one embodiment of the invention.

Referring to FIG. 1, a cutaway, perspective view depicts ridge risers 10 according to one embodiment, incorporated into a roof 12. The roof has a longitudinal direction 14, a lateral direction 16, and a transverse direction 18. As shown, the roof 12 has a structural portion 26 that includes rafters 28 that support a pair of sheathing portions 30, each of which is attached to the rafters 28 at a predetermined slope. Each of the sheathing portions 30 may consist of plywood, laminated wood material, or similar sheathing material used in the roofing industry. Each of the sheathing portions is covered by an underlayment 32, otherwise known as "felt," which may consist of tar paper or some other generally moisture repellant material.

The ridge risers 10 are used to elevate an attachment block 34 above the sheathing portions 30. The attachment block 34 is positioned above an imaginary apex of the sheathing portions 30, i.e., a line along which the sheathing portions 30 would intersect if they were longer. The attachment block 34 is a block of wood, metal, or some other structural material. In the case of wood, the attachment block 34 may be a 1×2, 2×2, or any other standard or desired surfaced lumber size, in inches. The attachment block 34 may alternatively be dimensioned in unsurfaced and/or metric terms. Multiple attachment blocks 34 may be disposed end-to-end along the longitudinal direction 14, as will be shown and described subsequently.

The structural portion 26 of the roof 12 includes the rafters 28, the sheathing portions 30, and the attachment block 34. The roof 12 has a first side 36 and a second side 38, which may be symmetrical to each other, as depicted, or may be asymmetrical. Each of the first and second sides 36, 38, includes the corresponding sheathing portion 30, the corresponding underlayment portion 32, and the rafters 28 disposed underneath the corresponding sheathing portion 30.

The ridge riser 10 is designed for supporting an attachment block 34 at a roof ridge 35. In this embodiment, the roof ridge 35 is positioned at the apex of the roof or other local peak that is not inclined, or in other words, at the apex of the sheathing portion 26 or the apex of the rafters 28 or sheathing portion 30. The ridge riser 10 could also be used with a "hip," which has an inclined external angle formed by the intersection of two sloping roof planes. For simplicity, the term "roof ridge" will be used to refer to both a roof ridge and a hip, both of which are depicted in FIG. 1 and depicted as item number 35. Thus, the ridge riser 10 is designed to support an attachment block 34, regardless of whether the attachment block 34 is positioned at the apex of the roof or at a hip/window box.

Each of the ridge risers 10 has a pair of legs 40 designed to be attached to the sheathing portions 30 and/or rafters. The legs 40 of each ridge riser 10 converge at a cradle 42 designed to support and retain the attachment block 34. In this application, a "cradle" includes any device capable of supporting the weight of an attachment block and of preventing motion of the attachment block along the lateral direction 16. The cradle 42 includes a floor 44 and a pair of side walls 46 that extend upward from the floor 44, adjacent to the legs 40. The floor 44 has a length in the lateral direction 16 that is selected to receive the desired size attachment block 34. For example, if the attachment block 34 is a standard 2×2, it may have a lateral dimension of approximately 1½ inches. Thus, the floor may have a lateral length slightly larger than 1½ inches.

Each of the legs 40 has a plurality of substrate attachment holes 50 toward the lower end. The substrate attachment holes 50 are used to attach the legs 40 to the sheathing portions 30 and/or the rafters 28. Fasteners 52, such as screws, nails, or the like, may be inserted through the attachment holes 50 and seated in the corresponding sheathing portion 30 and/or rafter 28 to affix the legs 40 to the sheathing portion 30 and/or rafter 28. The attachment holes 50 may be arranged in a way designed to prevent relative translation or rotation between the legs 40 and the sheathing portions 30.

As illustrated in FIG. 1, the legs 40 are disposed to lie on top of the sheathing portions 30. However, according to alternative embodiments, the legs 40 may extend underneath the sheathing portions 30 and bend to extend through the space between the sheathing portions 30. In such a configuration, the legs 40 may be attached exclusively to the rafters 28 or the associated sheathing portion 30. If desired, the legs 40 may be sandwiched between each of the rafters 28 and the adjoining sheathing portion 30. Thus, the ridge risers 10 may be installed after construction of the rafters 28 but prior to installation of the sheathing portions 30.

Returning to the embodiment of FIG. 1, each of the legs 40 has a block attachment hole 54 used to fix the attachment block 34 in place within the cradle 42. Fasteners 56, such as screws, nails, or the like, may be inserted through the block attachment holes 54 and seated in the attachment block 34 to prevent withdrawal of the attachment block 34 from the cradle 42. If desired, the block attachment holes 54 of each ridge riser 10 may be offset slightly from each other in the transverse direction 18, or in the longitudinal direction 14, to reduce the probability that the fasteners 56 will interfere with each other within the attachment block 34.

The ridge risers 10 may be manufactured with the legs 40 in a straight configuration. Each of the legs 40 may be bent at a variety of positions, and at a variety of angles, so that each ridge riser 10 can be adapted for use with various roof slopes, roof covering elements, and ventilation schemes. For example, a more steeply sloped roof may require that the legs 40 be bent at a shallower, i.e., more obtuse, angle, while a less steeply sloped roof requires that the legs 40 be bent closer to a right angle. Furthermore, the use of thicker roof covering elements, such as curved tiles or metal, may require that the attachment block 34 be disposed at a comparatively high elevation, while a lower elevation of the attachment block 34 is optimal for thinner roof covering elements, such as asphalt shingles or flat tiles.

Such versatility may be provided through the use of scores 60, 62, 64 formed in the legs 40 along the longitudinal direction 14. More precisely, a first score 60 is disposed near the tops of the legs 40, and may be used for applications in which minimal elevation of the attachment block 34 is required. This may be appropriate if a thin type of roof covering element such as asphalt shingles is used. A second score 62 is disposed below the first score 60, for use with low profile curved roof covering elements such as gently curved tiles. A third score 64 is positioned below the second score 62 for use with high profile curved roof covering elements such as more sharply curved tiles.

The scores 60, 62, 64 need not be uniformly spaced apart, but may be disposed at heights adapted for use with specific roof covering elements or ventilation schemes. The scores 60, 62, 64 may be labeled to provide guidance regarding where the leg 40 should be folded for each roof covering element or ventilation scheme.

In application, the legs 40 are initially straight. The roofer simply bends the legs 40 of each ridge riser 10 to the desired angle, at the desired score 60, 62, or 64. In some embodiments, the legs 40 may be structured such that they can be bent or folded by hand along any of the scores 60, 62, or 64. In this application, bending or folding "by hand" refers to bending or folding with the hands without the use of additional tools.

The roofer may attach the ridge risers 10 to the sheathing portions 30 with the fasteners 52, place the attachment block 34 in the cradles 42, and then apply the fasteners 56 to fix the attachment block 34 in place. In the alternative, the roofer may attach the ridge risers 10 to the attachment block 34 before or after the legs 40 have been bent as desired. The roofer may then attach the ridge risers 10, with the affixed attachment block 34, to the sheathing portions 30.

The ridge risers 10 are spaced apart at a distance suitable to adequately support the attachment block 34. Thus, the spacing used depends, in part, upon the strength of the attachment block 34. The ridge risers 10 may be spaced apart by two feet (from center to center) or less. The ridge risers 10 may advantageously be spaced apart at the same spacing as the rafters 28 so that each ridge riser 10 can be anchored by a rafter 28. Rafters are typically spaced apart with a spacing of two feet or sixteen inches, although other spacing arrangements may be used.

Horizontal battens may be installed on the sheathing portions 30 for attachment of roof covering elements below the level of the ridge. One such horizontal batten 66 is shown in phantom, and may be attached to the sheathing portion 30 over a portion of the legs 40 of the ridge risers 10. Fasteners (not shown), such as screws or nails, may be used to affix the horizontal batten 66 in place.

The structural portion 26 of the roof 12 is covered by a roof covering assembly 70 designed to generally shield the structural portion 26 from weather while permitting ventilation. In addition to the ridge risers 10, the roof covering assembly 70 includes covering elements 72. The covering elements 72 include sheathing covering elements 74 designed to cover the sheathing portions 30 and ridge covering elements 76 designed to cover the attachment block 34 and the gap between the sheathing portions 30.

The sheathing covering elements 74 and ridge covering elements 76 are depicted in cutaway form in FIG. 1; in practice, the sheathing portions 30 and ridge would preferably be substantially covered by the covering elements 76. The covering elements 72 may include any of a variety of roofing products, including but not limited to shingles, shakes, tiles, slate units, metal units, and synthetic units. If desired, a venting screen (not shown) formed of a woven fiber, plastic, or other flexible construction for venting purposes may optionally be disposed in the ridge area, underneath the ridge covering elements 76.

Each of the ridge risers 10 has a thickness 78, which may be consistent along the legs 40 and the cradle 42. According to one example, the thickness 78 ranges from about one thirty-second of an inch to about one fourth of an inch. More specifically, the thickness 78 may be about one sixteenth of an inch. The thickness 78 may vary depending on the weight of the attachment block 34 and the covering elements 72, local weather conditions, and other factors. Furthermore, a comparatively greater thickness may be used to enable the ridge riser 10 to act as an anchor for a safety restraint assembly, as will be shown and described subsequently.

The ridge risers 10 may be formed of a variety of materials, including metals, plastics, and composite materials based on plastic or metal matrices. Furthermore, the ridge risers 10 may be manufactured in a wide variety of ways. According to one example, the ridge risers 10 may be stamped from strips of a metal such as steel. One possible method of manufacturing the ridge risers 10 will be further illustrated in connection with FIGS. 2, 3, and 4, as follows.

Figure 2:
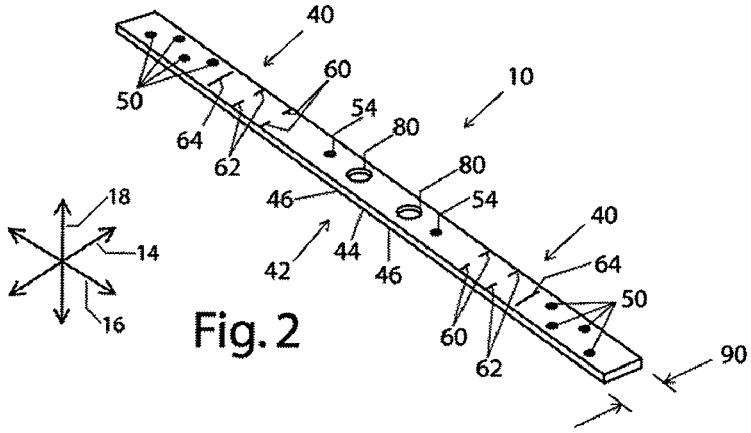
FIG. 2 is a perspective view of one stage of a manufacturing process that may be used to create the ridge risers of FIG. 1, in which a single stamping operation has been performed on a strip of metal.

Referring to FIG. 2, the ridge riser 10 is depicted after the performance of one manufacturing step. More specifically, the ridge riser 10 may be formed from a strip of steel. The strip may be cut from a longer strip that has been wound to form a roll.

The strip may be cut in conjunction with a stamping operation used to form some of the features of the ridge riser 10. For example, the substrate attachment holes 50, the block attachment holes 54, and the scores 60, 62, 64 may all be stamped into the strip of steel when the strip is cut to the proper length. Hence, use of the term "scores" does not require the use of a scoring operation. Rather, any operation capable of forming grooves may be used to create the scores 60, 62, 64. In alternative embodiments, perforations or other features that facilitate bending may be used in place of the scores 60, 62, 64. These features may be formed using any suitable technique.

Additionally, facing holes 80 may be cut into the side walls 46 of the cradle 42. When the cradle 42 is formed, the facing holes 80 will align with the block attachment holes 54 to permit insertion of the fasteners 56 through the side walls 46. The facing holes 80 may be made somewhat larger than the block attachment holes 54 to ensure that no portion of the side walls 46 impedes passage of the fasteners 56 into the attachment block 34.

As shown, the strip has a longitudinal width 90, or width along the longitudinal direction 14. The width 90 of the strip is consistent along the longitudinal direction 14. The subsequent processing steps do not significantly alter the width 90. Hence, the ridge riser 10 has a substantially uniform longitudinal width, which is equal to the width 90 of the strip.

Figure 3:
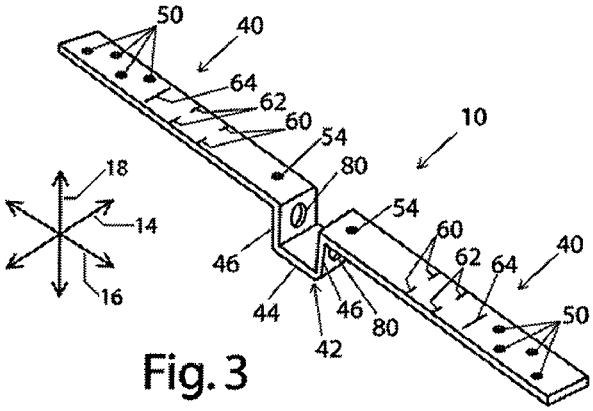
FIG. 3 is a perspective view of a subsequent stage of the manufacturing process, in which a second stamping operation has been performed.

Referring to FIG. 3, a perspective view shows the ridge riser 10 after the performance of another operation. More precisely, a second stamping operation may be used to form the cradle 42, leaving the legs 40 coplanar. A rectangular die may simply be pressed downward against the center of the strip of metal to indent the metal, thereby forming the floor 44 and the side walls 46. A bending or folding operation may alternatively be used to obtain the same configuration.

Figure 4:
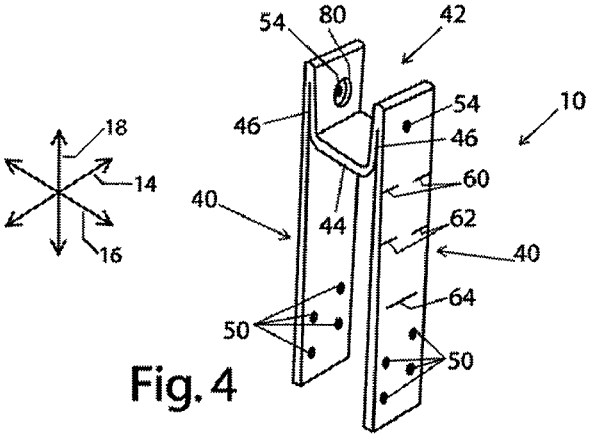
FIG. 4 is a perspective view of a further subsequent stage of the manufacturing process, in which a third stamping operation has been performed to provide the finished ridge riser.

Referring to FIG. 4, a perspective view shows the ridge riser 10 in finished form, after the performance of yet another operation. A third stamping operation may be used to bend the legs 40 at an angle of approximately 180° with respect to the side walls 46. For example, the ridge riser 10 may be inverted and placed so that the cradle rests on a rectangular block, and then the legs 40 may be folded upward until they are parallel to each other. Again, a bending or folding operation may be used to obtain the same configuration.

The foregoing is simply one of many possible manufacturing processes that may be used to form the ridge riser 10. According to other embodiments, the ridge riser 10 need not even be formed of steel, but may be formed of other metals, plastics, composites, or the like. Any corresponding manufacturing process may therefore be used.

Figure 5:
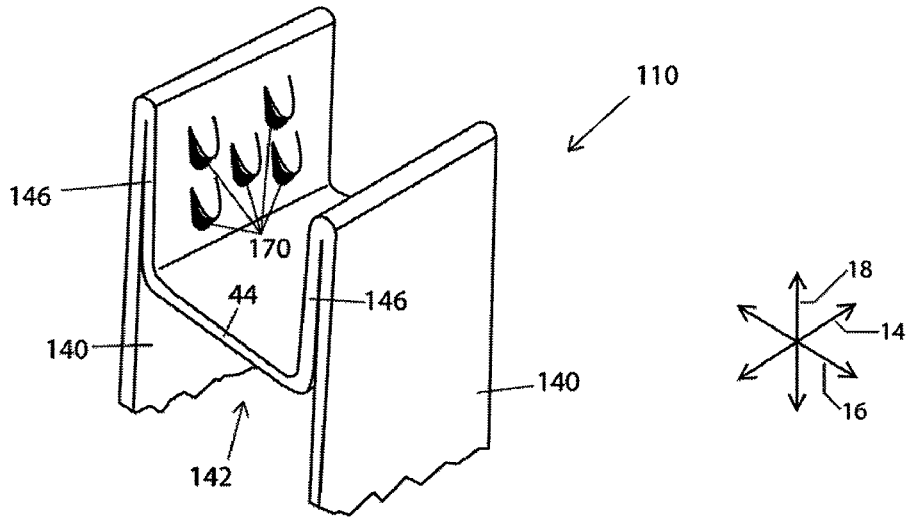
FIG. 5 is a perspective view of a portion of a ridge riser according to one alternative embodiment, in which retention cleats retain the attachment block within the cradle.
Figure 6:
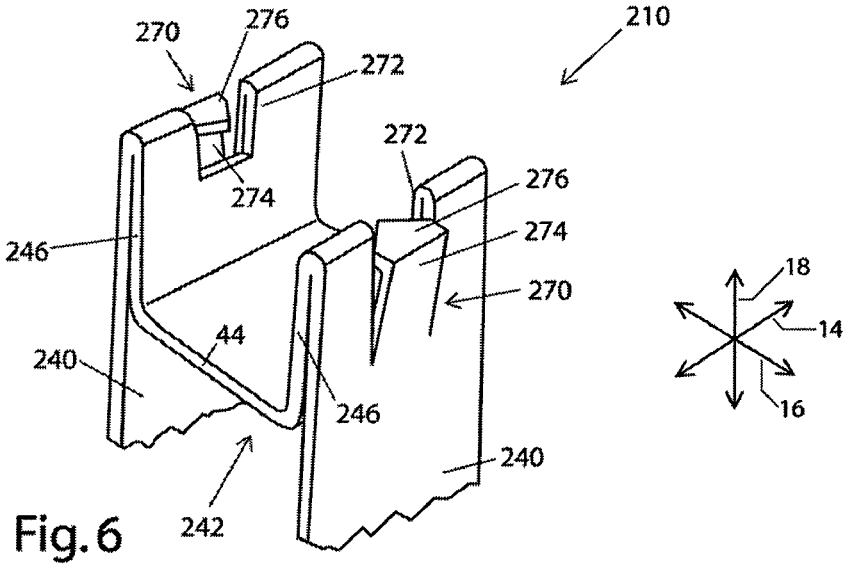
FIG. 6 is a perspective view of a portion of a ridge riser according to another alternative embodiment, in which retention members formed in the side walls and upper portions of the legs are used to retain the attachment block within the cradle.

Fasteners 56 need not be used to affix the attachment block 34 to a ridge riser. FIGS. 5 and 6 depict alternative ridge riser configurations in which separate fasteners are not needed.

Referring to FIG. 5, a perspective view shows the upper portion of a ridge riser 110 according to an alternative embodiment. The ridge riser 110 has legs 140 similar to the legs 40 of the previous embodiment, except that no block attachment hole is provided. The ridge riser 110 has a cradle 142 with a floor 44 and side walls 146; the side walls 146 are configured to retain the attachment block 34 without separate fasteners.

More specifically, the facing holes 80 are omitted, and a plurality of retention members are formed in each of the side walls 146. In this application, a "retention member" is any member integrally formed with a ridge riser that serves to block withdrawal of the attachment block 34 from a cradle of the ridge riser.

In FIG. 5, the retention members take the form of cleats 170. The retention cleats 170 may simply be pointed tabs cut from the material of the side walls 146 and folded inward so that the points are oriented inward and downward. When the attachment block 34 is inserted into the cradle 142, the sides of the attachment block 34 are able to slide downward along the cleats 170. However, if upward force is applied against the attachment block 34, the points of the cleats 170 embed themselves in the sides of the attachment block 34 so that the attachment block 34 cannot be removed from the cradle 142.

With such an arrangement, no additional fasteners need be used. In addition, the roofer need not perform any additional steps besides inserting the attachment block 34 into the cradle 142. Thus, the part count of the roof is reduced and installation is facilitated.

Referring to FIG. 6, a perspective view shows the upper portion of a ridge riser 210 according to another alternative embodiment. The ridge riser 210 has legs 240, a cradle 242, and side walls 246. The block attachment holes 54 and facing holes 80 are again omitted. Retention members 270 are formed in the legs 240 and side walls 246, and are configured to be actuated to lock the attachment block 34 in place.

More precisely, the retention members 270 are stamped or otherwise cut from the side walls 246 and the upper portions of the legs 240 to leave slots 272, in which the retention members 270 are disposed. Each of the retention members 270 has a shank 274 angled outward with respect to the legs 240. Each shank 274 terminates in a locking tab 276. The locking tabs 276 are oriented inward, toward the positions in which the sides of the attachment block 34 will rest. The locking tabs 276 are pointed to facilitate penetration of the side walls of the attachment block 34.

After the attachment block 34 has been inserted into the cradle 242, the shanks 274 may be struck, for example, with a hammer, to drive the locking tabs 276 into the sides of the attachment block 34. Such an arrangement provides for easy and rapid retention of the attachment block 34 without additional fasteners. Additionally, the attachment block 34 may be positioned, for example, by sliding the attachment block 34 in the longitudinal direction 14 within the cradle 242 and fixed in place when it reaches the desired position.

Ridge risers may also be adapted for use with supplemental venting systems, such as double batten roof configurations. In double batten systems, "vertical battens" are attached to the substrate, extending from the ridge toward the eaves. Horizontal battens are attached to the tops of the vertical battens, and the shingles are attached to the horizontal battens as in a conventional, single batten roofing arrangement. The double batten arrangement permits for the flow of air above the underlayment, between the vertical battens.

If desired, ridge risers 10, such as those depicted in FIG. 1, may be used with a double batten system by simply attaching the ridge risers 10 to the tops of the vertical battens. The ridge risers 10 would then naturally have the additional elevation required to accommodate the height added by the vertical battens. In the alternative, ridge risers may be specially configured to provide the additional elevation. Such a configuration is depicted in FIG. 7.

Figure 7:
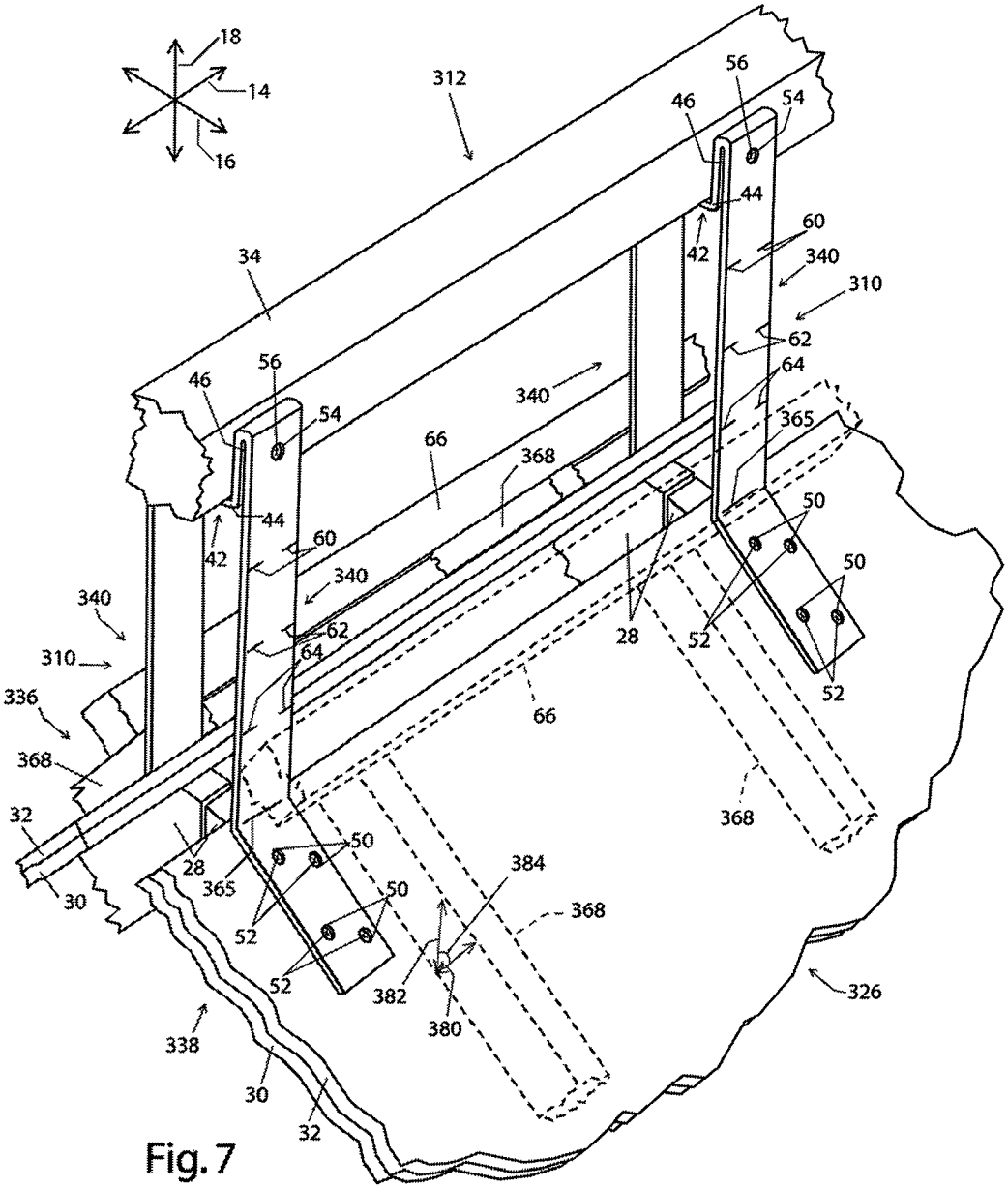
FIG. 7 is a perspective view of a portion of a roof that incorporates ridge risers according to another alternative embodiment of the invention in which the ridge riser is adapted for use with a double batten roofing system.

Referring to FIG. 7, a perspective view depicts a pair of ridge risers 310 according to another alternative embodiment, used in conjunction with a roof 312. The roof 312 includes a structural portion 326 in which a double batten system is used to provide additional ventilation, as described above. The roof has a first side 336 and a second side 338, each of which includes a portion of the rafters 28 and a corresponding sheathing portion 30 and underlayment portion 32. Covering elements have been omitted from FIG. 7 for simplicity. Each of the ridge risers 310 includes a pair of legs 340, which are joined by a cradle 42 like that of FIG. 1.

The legs 340 have additional length to compensate for the increased height of the double batten system. Additionally, each leg 340 may have a fourth score 365 positioned below the third score 64. Thus, the ridge risers 310 may be used with conventional single batten systems by folding the legs 310 at the first, second, or third scores 60, 62, or 64, depending on the desired amount of venting and/or the type of roof covering element used. For double batten systems, the second, third, or fourth scores 62, 64, or 365 may be used to add the necessary additional height. Again, the scores 60, 62, 64, 365 may be labeled to indicate where they should be bent. More or fewer scores 60, 62, 64, 365 may be used, and the scores 60, 62, 64 365 may be relatively positioned in a variety of ways.

Vertical battens 368 are shown in phantom beneath the exemplary horizontal batten 66. The additional height of the ridge risers 310 is determined by the height of the vertical battens 368. This may be determined through the use of trigonometry.

More precisely, each of the vertical battens 368 has a thickness 380. According to one example, each of the vertical battens 368 may take the form of 1×2, 2×2, 2×4, or 2×6 piece of surfaced lumber, dimensioned in inches. The thickness 380 is thus the actual dimension that corresponds to the nominal dimensions listed above. Unsurfaced and/or metric sized lumber may alternatively be used. The vertical battens 368 add an additional height 382 somewhat greater than the thickness 380.

This additional height 382 is determined by the slope of the roof, which is also the angle 384 between the thickness 380 and the additional height 382. Simple trigonometry shows that the additional height 382 is equal to the thickness 380 divided by the cosine of the angle 384. This additional height 382 may be used to determine the overall length of the legs 340 and/or the positioning of the scores 60, 62, 64, 365. Additional scores (not shown) may be added to the legs 340 to enable easy adaptation of the ridge risers 310 to the added height of the double batten system. Such additional scores may be positioned and labeled for standard roof slopes so that the roofer is not required to perform the trigonometric analysis above to determine the proper folding position.

In many roofing situations, the ridge is longer than the standard length attachment block. Hence, multiple attachment blocks are laid end-to-end along the ridge. It is desirable to align the ends of the attachment blocks in a simple and rapid manner. One embodiment of the invention designed to provide easy alignment and juncture between attachment blocks will be shown and described in connection with FIG. 8.

Figure 8:
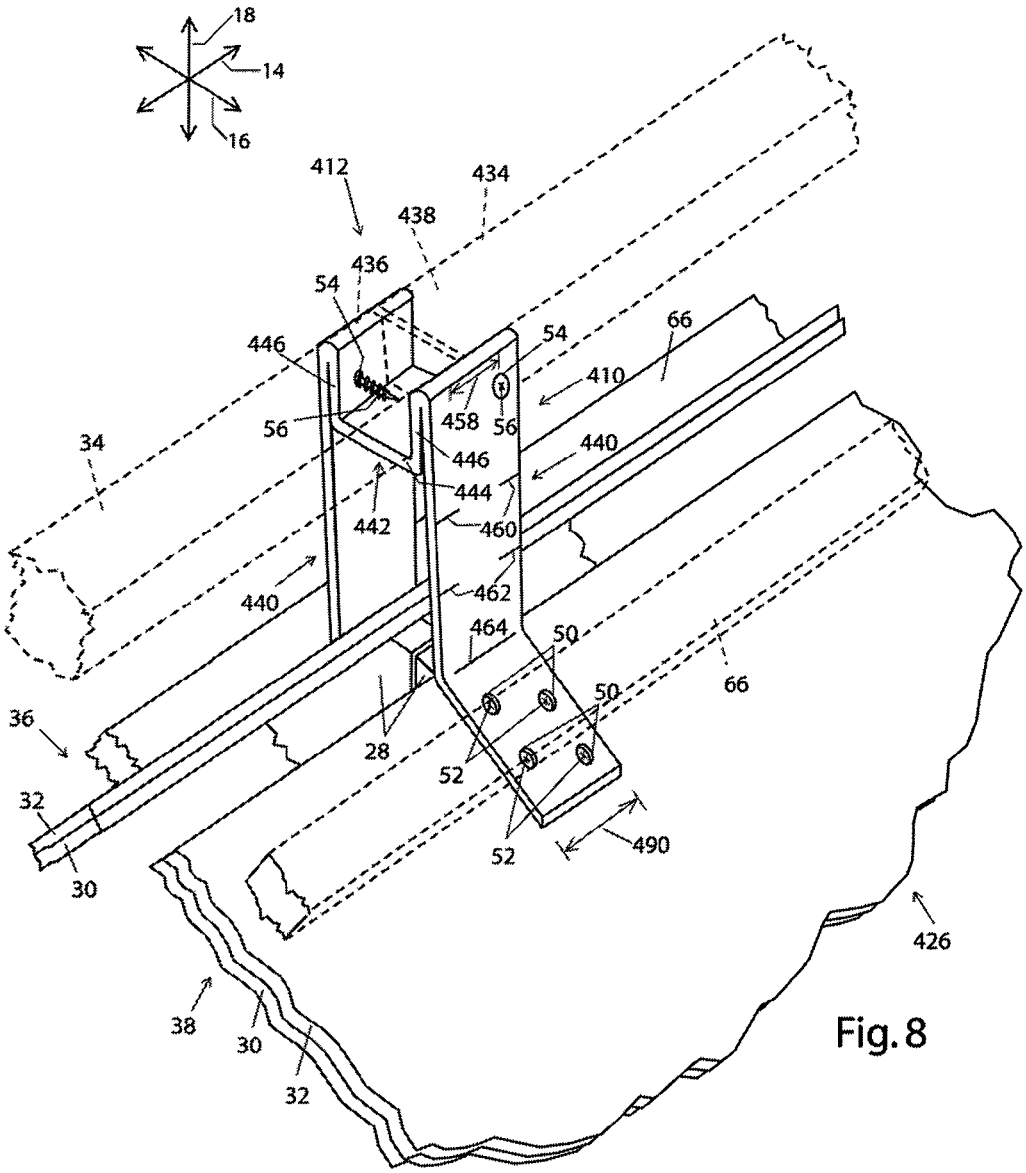
FIG. 8 is a perspective view of a portion of a roof that incorporates a ridge riser according to another alternative embodiment of the invention in which the ridge riser is adapted to act as a junction between two adjoining attachment blocks.

Referring to FIG. 8, a perspective view illustrates a ridge riser 410 according to another alternative embodiment, used in conjunction with a roof 412. The roof 412 includes a structural portion 426 similar to that of FIG. 1. Covering elements have again been omitted for simplicity.

As shown, the structural portion 426 includes an attachment block 34 and a second attachment block 434 aligned end-to-end with the attachment block 34. More precisely, the attachment block 34 has an end 436 disposed to abut an end 438 of the second attachment block 434.

The ridge riser 410 has a longitudinal width 490 that is generally greater than the longitudinal width 490 of the ridge riser 110. Otherwise, the ridge riser 410 has a configuration similar to that of the ridge riser 410. The ridge riser 410 has a pair of legs 440 that converge to form a cradle 442 designed to receive and retain the ends 436, 438. The cradle 442 has a floor 444 and a pair of side walls 446 on either side of the floor 444.

Each of the legs 440 has a plurality of substrate attachment holes 50, into which fasteners 52 are inserted and seated into the corresponding sheathing portion 30 and/or the corresponding portion of the rafters 28. Furthermore, each side wall 446 has a block attachment hole 54. As shown, the block attachment holes 54 of the two side walls 446 are longitudinally offset from each other. Thus, a fastener 56 inserted into one of the block attachment holes 54 will seat within the end 436 of the attachment block 34, while a fastener 56 inserted into the other block attachment hole 54 seats within the end 438 of the second attachment block 434.

The block attachment holes 54 are longitudinally separated by an offset 458 designed to cause the fasteners 56 to easily and reliably seat within different ends 436, 438. According to certain examples, the offset 458 may range from about one half inch to about two inches. Further, the offset may range from about ¾ of an inch to about 1¼ inches. An offset of about one inch may be used. More offset block attachment holes could also be provided to accommodate additional fasteners, if desired.

As with the legs 40 of the ridge riser 10 of FIG. 1, each of the legs 440 has plurality of scores, such as a first score 460, a second score 462, and a third score 464. The legs 40 may each be bendable by hand along any of the scores 460, 462, or 464 to enable use with a variety of roof slopes and desired heights of the cradle 442.

The ridge riser 410 has a longitudinal width 490 selected to enable the cradle 442 to receive and retain both of the ends 436 and 438. The longitudinal width 490 may range from about one inch to about six inches. More specifically, the longitudinal width 490 may range from about one and one half inches to about two and one half inches. Yet more precisely, the longitudinal width 490 may be about one and three quarters inches.

A ridge riser according to the invention may also be designed to act as an anchor for a safety restraint assembly. Thus, separate anchors need not be installed on a roof. Two possible embodiments that enable use of a ridge riser as a safety restraint assembly anchor will be shown and described in connection with FIGS. 9 and 10.

Figure 9:
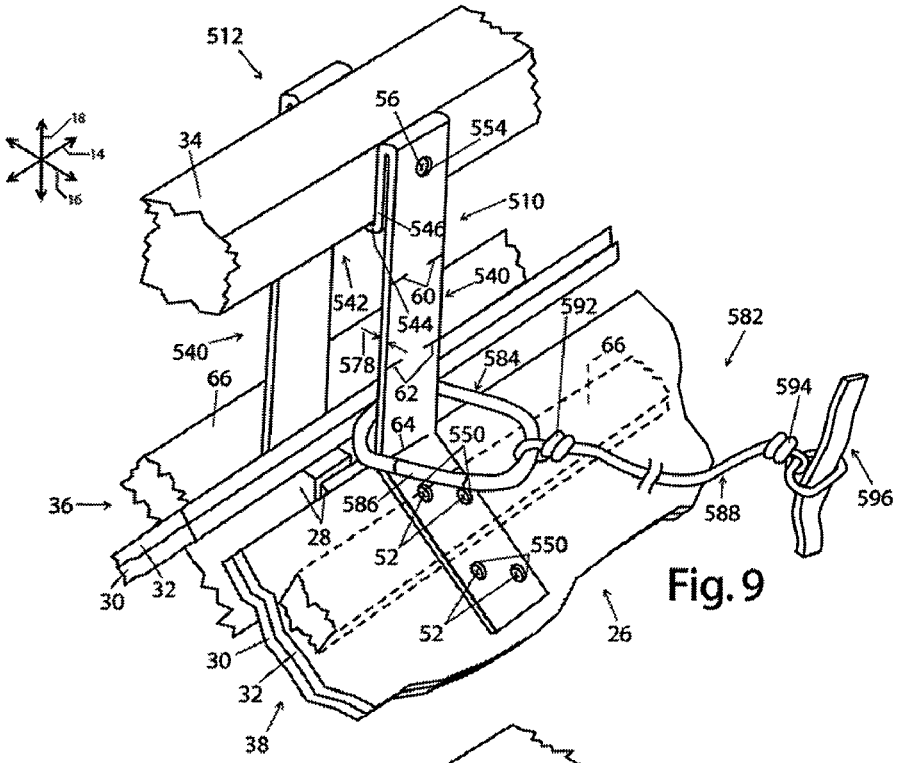
FIG. 9 is a perspective view of a portion of a roof that incorporates a ridge riser according to another alternative embodiment of the invention in which the ridge riser is thickened to act as an anchor for a safety restraint assembly.

Referring to FIG. 9, a perspective view illustrates a ridge riser 510 according to another alternative embodiment, used in conjunction with a roof 512. The roof 512 includes a structural portion 26 like that of FIG. 1. Covering elements have again been omitted for simplicity.

As shown, the ridge riser 510 has a shape generally similar to that of the ridge riser 10 of FIG. 1. The ridge riser 510 has a pair of legs 540 that converge to define a cradle 542 shaped to receive an attachment block 34. The cradle 542 has a floor 544 and a pair of side walls 546 extending in the transverse direction 18, i.e., upward, from either side of the floor 544. Substrate attachment holes 550 of the legs 540 enable insertion of fasteners 52 through each of the legs 540 and into the corresponding sheathing portion 30 and/or the corresponding portion of the rafters 28. Similarly, block attachment holes 554 of the side walls 546 permit the insertion of fasteners 56 through each of the side walls 546 and into the attachment block 34. Each of the legs 540 has a plurality of scores 60, 62, 64 to facilitate bending for roof slope adaptation or ridge riser height adjustment.

The ridge riser 510 differs from those disclosed previously in that it has a comparatively larger thickness 578. For example, the ridge riser 510 may have a thickness 578 ranging from about one eighth to about three eighths of an inch. More specifically, the thickness 578 may be about one quarter of an inch. The enlarged thickness 578 adds flexural rigidity so that the legs 540 are able to support the weight of a person without unduly deflecting.

The thickness 578 may be substantially uniform along the length of the ridge riser 510. In alternative embodiments, varying thicknesses may be used. The location at which the thickness is at a maximum may advantageously be at the point of maximum bending stress, such as the bend at which the leg begins to extend upward from the sheathing 30 or just above the uppermost substrate attachment hole.

The legs 540 may be thin enough to still be bendable by hand along any of the scores 60, 62, 64. Alternatively, tools, such as standard tools, specialized folding brackets, or the like, may be required. If desired, the scores 60, 62, 64 may be omitted altogether, and the ridge riser 510 may be bent into the desired shape at the time of manufacture. For example, ridge risers 510 may be manufactured at a plurality of pre-established height/roof slope combinations, so that no bending at the job site is required.

Due to their increased thickness 578, the legs 540 of the ridge riser 510 have a structural rigidity sufficient to support the weight of a person. Thus, a safety restraint assembly, or restraint assembly 582, may be attached to one of the legs 540. Such a restraint assembly may have a wide variety of configurations. In the exemplary configuration illustrated in FIG. 9, the safety restraint assembly 582 has a clip 584 designed to engage the leg 540. The clip 584 may be somewhat similar to a mountaineering carabineer, with a pivoting portion 586 designed to pivot inward to permit the clip 584 to be engaged or disengaged with the leg 540.

The restraint assembly 582 also has a safety line 588 with an anchoring end 592 and a harness end 594. The anchoring end 592 is attached to the clip 584 and the harness end 592 is attached to a harness 596, only a portion of which is depicted in FIG. 9. The safety line 588 may be constructed of braided nylon, simple rope, metal cable, or the like.

The clip 584 may simply be attached to the leg 540 of the ridge riser 510, as illustrated, to provide anchoring of the restraint assembly 582. No additional anchors need be added to the roof 510 for the restraint assembly 582. It may be desirable to provide a ridge riser capable of providing such an anchoring function without requiring the full thickness 578 of the ridge riser 510. Such a ridge riser will be shown and described in connection with FIG. 10.

Figure 10:
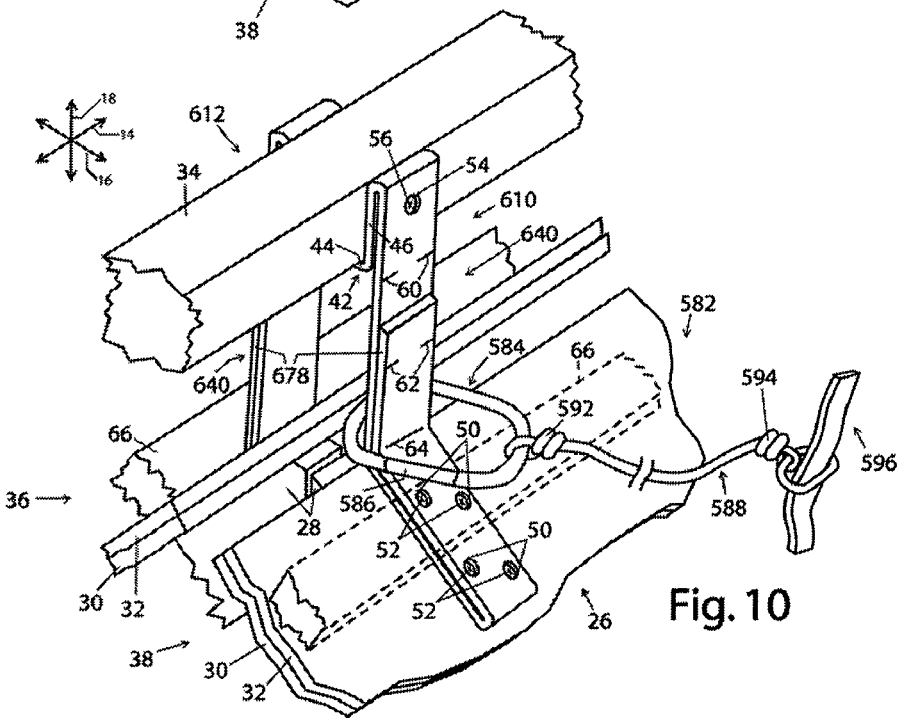
FIG. 10 is a perspective view of a portion of a roof that incorporates a ridge riser according to another alternative embodiment of the invention in which each leg of the ridge riser is doubled over against itself to provide anchoring for a safety restraint assembly.

Referring to FIG. 10, a perspective view illustrates a ridge riser 610 according to yet another alternative embodiment, used in conjunction with a roof 612. The roof 612 includes a structural portion 26 like that of FIG. 1. Covering elements have again been omitted for simplicity.

As shown, the ridge riser 610 also has a shape generally similar to that of the ridge riser 10 of FIG. 1. The ridge riser 610 has a pair of legs 640 that converge to define a cradle 42 shaped to receive an attachment block 34. The cradle 42 has a floor 44 and a pair of side walls 46 extending from either side of the floor 44. Substrate attachment holes 50 on the legs 640 enable insertion of fasteners 52 through each of the legs 640 and into the corresponding sheathing portion 30 and/or the corresponding portion of the rafters 28. Similarly, block attachment holes 54 on the side walls 46 permit the insertion of fasteners 56 through each of the side walls 46 and into the attachment block 34. Each of the legs 640 has a plurality of scores 60, 62, 64 to facilitate bending for roof slope adaptation or ridge riser height adjustment.

The ridge riser 610 may have a thickness comparable to the thickness 78 of the ridge riser 10 of FIG. 1. However, each of the legs 640 of the ridge riser 610 has a doubled back portion 678 that is folded into alignment with the remainder of the leg 640. The leg 640 may be folded at the time of manufacture to form the doubled back portion 678. In the alternative, the leg 640 may be folded by the user to form the doubled back portion 678. An additional score (not shown) may be formed on the opposite side of the leg 640 for this purpose. The scores 60, 62, 64 of the doubled back portion 678 may be aligned with those of the remainder of the leg 640 to facilitate parallel bending of the doubled back portion 678 and the remainder of the leg 640.

Due to the existence of the doubled back portions 678, the lower portion of each leg 640 has a double effective width. This effective width provides the structural rigidity needed to support the weight of a person. Although only one leg 640 need be strengthened in such a manner to serve as an anchoring point, FIG. 10 depicts doubled back portions 678 on both of the legs 640. A restraint assembly 582 like that disclosed in connection with FIG. 9 may be attached to one of the legs 640 to anchor the restraint assembly 582.

The legs 640 may be folded along the scores 60, 62, 64 in a manner similar to that disclosed previously. One or more of the scores 60, 62, 64 may be formed on the doubled back portion 678 as well as on the remainder of the leg 640, so that adjacent scores 60, 62, 64 of the doubled back portion 678 and the remainder of the leg 640 may be folded to create adjacent, aligned angles like that depicted in FIG. 10 in connection with the third score 64. Thus, use of the doubled back portion 678 may require multiple folding operations for each leg 640, but may make such folding operations comparatively easy because the doubled back portion 678 and the remainder of the leg 640 are individually thin and can be separately folded.

Figure 11:
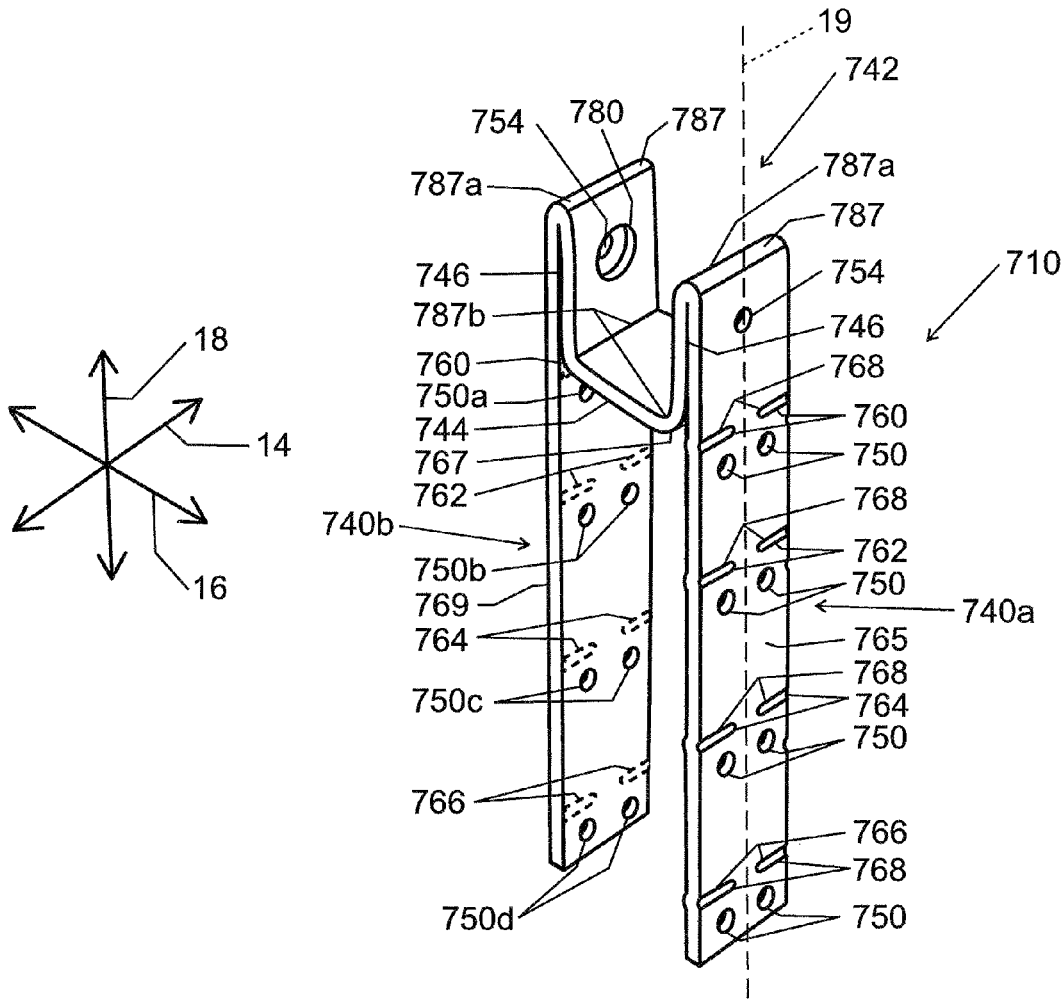
FIG. 11 is a perspective view of another embodiment of a ridge riser.

Referring now to FIG. 11, a perspective view illustrates a ridge riser 710 according to another embodiment of the present invention. The ridge riser 710 is similar to the embodiments of the ridge risers discussed above (including the embodiment shown in FIG. 4). Those of skill in the art will recognize that much of the above-recited description would apply equally to the ridge riser 710 of FIG. 11. For simplicity and brevity, this description will not be repeated.

The ridge riser 710 supports an attachment block 34 (shown in FIG. 1) at a roof ridge 35 (shown in FIG. 1). As noted above, this roof ridge 35 may be located at the apex of the roof or may be a "hip" that is used in conjunction with a window or window box. As also indicated above, for simplicity, the term "roof ridge" or "ridge" will be used to refer to both a roof ridge and a hip.

The ridge riser 740 will include a pair of legs 740. These legs may be referred to as first leg 740*a* and second leg 740*b*. The legs 740 may be attached to the sheathing portions 30 (shown in FIG. 10) and/or rafters. The first leg 740*a* is attached to a first sloping side 36 of the roof ridge 35. The second leg 740*b* attaches to a second sloping side 38 of the roof ridge 35. (Both the first side 36 and the second side 38 are shown in FIG. 1).

Figure 13:
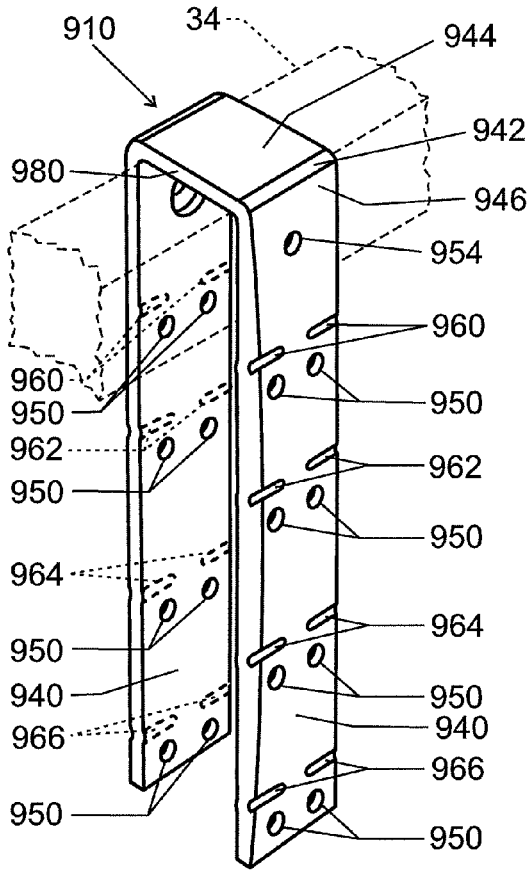
FIG. 13 is a perspective view of another embodiment of a ridge riser.

The legs 740 of each ridge riser 710 converge at a cradle 742 that supports and retains the attachment block 34 (shown in FIG. 1). In the embodiment of FIG. 11, the cradle 742 is generally "U-shaped." In other words, the cradle 742 has the shape of an "upwards" shaped "U"—i.e., it has the shape normally associated with the letter "U". However, other embodiments may use a cradle 742 that has a downward or inverted "U" shape, as shown in FIG. 13. All such embodiments, whether having an upright or inverted U-shape, fall within the scope of the disclosed invention.

In some embodiments, the U-shaped cradle 742 may be formed by adding four bends 787 to the ridge riser 710. Each of these four bends 787 may extend across the entire width of the riser 710 (i.e., across the entire distance that the riser 710 extends in the longitudinal direction 14). Two top bends 787*a* may be used to form the side walls 746. The two side walls 746 connect the floor 744 of the cradle 742 to the legs 740. Two floor bends 787*b* may be used to form the floor 744.

As with the prior embodiments, the cradle 742 includes a floor 744 that has a length in the lateral direction 16 that is selected to support and receive the desired size attachment block 34. If the attachment block 34 is a standard 2×2, the block 34 may have a lateral dimension of approximately 1½ inches. Thus, in this case, the floor 744 may have a lateral length slightly larger than 1½ inches. Of course, other sizes for the ridge riser 710 or the floor 744 may also be used.

As with the previous embodiments, the ridge riser 710 is designed such that the legs 740 are bent (in the manner described above) at an angle of approximately 180°, or parallel, with respect to side walls 746. Likewise, the ridge riser 710 may be manufactured using the processes that are similar to and/or identical to those disclosed above.

The first leg 740*a*, the second leg 740*b*, and the cradle 742 are all integrally formed from a single strip of material. One way in which this piece may be formed from a single strip is described above in conjunction with FIGS. 2 through 4. This single strip of material may be made of metal, such as steel. Other metals may also be used. The strip of material may be, in one embodiment, 14 gauge metal. However, thinner materials may also be used (such as 16 gauge, 18 gauge, 20 gauge, 24 gauge, etc.).

In some embodiments, the single strip of metal used to form the ridge riser 710 has a uniform or substantially uniform longitudinal width. This width is the dimension of the riser 710 in the direction of the longitudinal axis 14. In some embodiments, this longitudinal width is less than six inches. In other embodiments, the longitudinal width of the strip of metal is greater than or equal to six inches. In some embodiments, the riser 710 does not have a uniform or substantially uniform width across the entirety of the riser 710.

Each of the legs 740 may have block attachment holes 754 used to fix the attachment block 34 in place within the cradle 742. Fasteners 56 (not shown in FIG. 11) may be inserted through the block attachment holes 754 and seated in the attachment block 34 to secure the attachment block 34 in the cradle 742. Positioning of the attachment block 34 in the cradle 742 may restrict movement of the attachment block 34 in the lateral direction 16. If desired, the block attachment holes 754 of each ridge riser 710 may be offset slightly from each other in the transverse direction 18, or in the direction of the longitudinal axis 14, to reduce the probability that the fasteners 56 will interfere with, or strike, each other within the attachment block 34.

Additionally, facing holes 780 may be cut into the side walls 746 of the cradle 742. As explained above, the facing holes 780 will align with the block attachment holes 754 to permit insertion of the fasteners 56 through the side walls 746. The facing holes 780 may be made somewhat larger than the block attachment holes 754 to ensure that no portion of the side walls 746 impedes passage of the fasteners 56 into the attachment block 34.

As shown in FIG. 11, the first leg 740*a* and the second leg 740*b* both include at least two weakened regions 760, 762. These regions may be referred to as a first weakened region 760 and a second weakened region 762. More than two weakened regions may be used. In fact, some embodiments may include three or four weakened regions. In the embodiment shown in FIG. 11, four weakened regions 760, 762, 764, 766 are used. These latter two weakened regions may be referred to as a third weakened region 764 and a fourth weakened region 766.

The term "weakened region" refers to a portion of the legs 740 which has been modified to allow a user to bend the legs 740 at one of the weakened regions 760, 762, 764, 766. In some embodiments, the weakened regions 760, 762, 764, 766 may be an area of the legs 740 that is made "thinner" so that it will be easier for a user to bend the legs 740 at this point. (In other words, as the legs 740 are "thinner" at the weakened regions, there is less rigidity at this location such that the user may bend the legs).

In other embodiments, the weakened regions 760, 762, 764, 766 comprise scoring (such as a single score or multiple scores) or indentations that are added to the legs to lessen or weaken the rigidity of the legs 740 at the particular location. Scores may be added to the legs 740 in the longitudinal direction 14. In further embodiments, the weakened regions 760, 762, 764, 766 comprise one or more holes, openings, or notches that are added to the legs to allow the legs 740 to be bent at this position. A single weakened region 760, 762, 764, 766 could comprise any combination of any of the foregoing, such as a thinned region, scoring, indentations, etc. The weakened regions 760, 762, 764, 766, in one embodiment, may be on the exterior sides 765, 769 of the legs 740.

As with the previously described embodiments, weakened regions 760, 762, 764, 766 may be added to the legs 740 in the longitudinal direction 14. The first weakened region 760 is disposed near the tops of the legs 740, and may be used for applications in which minimal elevation of the attachment block 34 is required. This may be appropriate with a thin type of roof covering element, such as roof tiles having a low profile. The second weakened region 762 is disposed below the first weakened region 760, and may be used with low profile curved roof covering elements, such as gently curved tiles or medium profile tiles. The third weakened region 764 is positioned below the second region 762, and may be used with high profile curved roof covering elements, such as more sharply curved tiles. A fourth weakened region 766 may also be used to accommodate, for example, high profile roof covering elements situated on a hip.

As shown in FIG. 11, the weakened regions 760, 762, 764, 766 need not be uniformly spaced apart, but may be disposed at heights adapted for use with specific roof covering elements or ventilation schemes. In some embodiments, the weakened regions 760, 762, 764, 766 may be labeled to provide guidance indicating where the legs 740 should be folded for each roof covering element or ventilation scheme.

In some embodiments, the weakened regions 760, 762, 764, 766 may comprise two aligned scores arranged in a generally linear fashion. As used herein, "generally linear" means that the overall profile of the weakened regions 760, 762, 764, 766 resembles a line. It is possible that portions of the weakened regions 760, 762, 764, 766 may be curved, zig-zaged, or sinusoidal, and still have the overall profile that is generally linear. In the embodiment of FIG. 11, each of the weakened regions 760, 762, 764, 766 comprise two distinct scores 768 that are generally aligned and/or generally collinear (i.e. they are generally positioned at the same height on the legs 740). Of course, other configuration and/or orientations for the weakened regions 760, 762, 764, 766 are also possible, including embodiments in which the weakened regions 760, 762, 764, 766 are not generally linear.

Embodiments of the ridge riser 710 may include weakened regions 760, 762, 764, 766 that are symmetrical. This means that the weakened regions 760, 762, 764, 766 on the first leg 740*a* are positioned at the same height/location as the corresponding weakened regions 760, 762, 764, 766 found on the second leg 740*b*. In other embodiments, the weakened regions 760, 762, 764, 766 on the first leg 740*a* are positioned at a height/location different from the height/location of the weakened regions 760, 762, 764, 766 on the second leg 740*b*.

In general, the weakened regions 760, 762, 764, 766 are designed such that a user may bend the legs 740 by hand—i.e., without the use of tools. In other words, because the weakened regions 760, 762, 764, 766 lessen the rigidity of the legs 740 at the location of the weakened region, a user can bend the legs 740 at this portion without the use of a tool (e.g., pliers, a hammer, or other bending/force providing tools).

The weakened regions 760, 762, 764, 766 may be manufactured in the ridge riser at some point before the ridge riser 710 is sold or otherwise provided to an installer. An installer is any individual that installs the ridge riser 710 on a structure. Thus, an installer of the ridge riser 710 does not need to add or create the weakened regions 760, 762, 764, 766. Further, when the weakened regions 760, 762, 764, 766 are bendable by hand, an end-user will not have to purchase tools that either create or bend the weakened regions 760, 762, 764, 766. Such a weakened region 760, 762, 764, 766 may be referred to as a "predefined weakened region."

In one embodiment, the weakened regions 760, 762, 764, 766 are created during the manufacturing process, i.e., at or about the same time that other aspects of the ridge riser 710 are fabricated. Such a weakened region 760, 762, 764, 766 may be referred to as a "manufactured weakened region."

As with the embodiments described above, the user may bend the legs 740 at one of the weakened regions 760, 762, 764, 766 so that the legs 740 are positioned at a particular height relative to the roof ridge 35. As there are multiple different weakened regions 760, 762, 764, 766, there is a set of heights that may be achieved using the ridge riser 710. Using his or her skill/knowledge, the roofer may select which of the particular heights matches the particular roof configuration and roof covering element; based upon this decision, the roofer will bend the legs 740 at the selected weakened regions 760, 762, 764, 766.

In some embodiments, the position of the weakened regions 760, 762, 764, 766 may be selected so that when the legs 740 are bent, the height of the legs 740 relative to the roof ridge 710 accommodate or correspond to the different types of tiles that are commonly used in tile roofs. These tiles used for tile roofs may be constructed, for example, of clay or concrete. These tiles may be classified as "low profile" tiles, "medium profile" tiles, or "high profile" tiles. "Low profile" tiles are those tiles that are generally flat or have a top surface rise that is less than or equal to one-half (½) inch. "Medium profile" tiles are tiles that have a rise (total height) to width ratio that is less than or equal to 1:5. "High profile" tiles have a rise (total height) to width ratio that is greater than 1:5 (measured in an installed condition). Thus, embodiments may be designed such that if the legs 740 are bent at the first weakened region 760, the height of the legs 740 relative to the ridge 35 is set to accommodate a low profile tile. Other embodiments may be designed such that if the legs 740 are bent at the second weakened region 762, the height of the legs 740 relative to the ridge 35 is set to accommodate a medium profile tile. Additional embodiments may further be designed such that if the legs 740 are bent at the third weakened region 764, the height of the legs 740 relative to the ridge 35 is set to accommodate a high profile tile.

As noted above, a fourth weakened region 766 may be added to each of the legs 740. The fourth weakened region 766 may be positioned at or proximate the bottom of each of the legs 740. The fourth weakened region 766 is positioned below the third weakened region 764. In some embodiments, the fourth weakened region accommodates high profile tiles at a hip.

In some embodiments, the configuration of the weakened regions 760, 762, 764, 766 is designed such that, when bent along these regions, the bend will be substantially linear in shape. As described above, the weakened regions 760, 762, 764, 766 may be generally linear. The weakened regions 760, 762, 764, 766 may also be perpendicular to, or substantially perpendicular to, the transverse axis 19 (which is shown in phantom). This generally linear configuration of the weakened regions 760, 762, 764, 766 means that the bend at the weakened region may also be generally linear or substantially linear. Other shapes of bends are also possible.

As shown in FIG. 11, the ridge riser 710 is in its "default position." This default position is the uninstalled configuration, after it has been formed such that the legs 740 are parallel or substantially parallel to the side walls 746.

In one embodiment, the distance between the bottom 767 of the cradle 742 and the first weakened region is approximately 1 1/16 inches; the distance between the first weakened region 760 and the second weakened region 762 is approximately 1 3/16 inches; the distance between the second weakened region 762 and the third weakened region 764 is approximately 1½ inches; and the distance between the third weakened region 764 and the fourth weakened region 766 is approximately 1¼ inches. As used herein, "approximately" means plus or minus ¼ of an inch.

It should be noted that the dimensions/measurements/distances for the ridge riser 710 are given herein as exemplary purposes only. Other embodiments may be designed in which the distances between the bottom 767 and the weakened regions 760, 762, 764, 766 are different from that which is provided herein. Still further embodiments may be designed in which the distances between the weakened regions 760, 762,764, 766 are different from that which was given herein.

As shown in FIG. 11, embodiments may include weakened regions 760, 762, 764, 766 that do not traverse the entirety of the strip in the direction of the longitudinal axis 14. Rather, in the embodiment shown in FIG. 11, the weakened regions 760, 762, 764, 766 (which are scores) only extend inwardly about ¼ inch from the outer edge of the legs 740. In other embodiments, the weakened regions 760, 762, 764, 766 may extend approximately ⅜ inch, ½ inch, 1 inch, 2 inches, etc. inwardly from the outer edge of the legs 740. Further embodiments may be designed in which the weakened regions 760, 762, 764, 766 traverse the entire longitudinal length of the legs 740. In some embodiments, only having the weakened regions 760, 762, 764, 766 extend ¼ inch inwardly from the edge of the legs 740 may be desirable in that having this smaller score does not compromise the strength of the metal after the legs 740 have been bent.

In the embodiment of FIG. 11, each of the legs 740 has a plurality of attachment holes 750. The attachment holes 750 are used to attach the legs 740 to the sheathing portions 30 (shown in FIG. 1) and/or the rafters 28 (shown in FIG. 1) or any other type of substrate. Fasteners 52 (shown in FIG. 1) may be inserted through the attachment holes 750 and seated in the corresponding sheathing portion 30 and/or rafter 28 to affix the legs 740 to the sheathing portion 30 and/or rafter 28. The attachment holes 750 may be arranged to prevent relative translation or rotation between the legs 740 and the sheathing portions 30.

However, unlike some of the embodiments discussed above, multiple sets of attachment holes are used on each of the legs 740. In the illustrated embodiment, a first set of attachment holes 750*a* may be positioned below the first weakened region 760, a second set of attachment holes 750*b* may be positioned below the second weakened region 762, and a third set of attachment holes 750*c* may be positioned below the third weakened region 764. A fourth set of attachment holes 750*d* may also be positioned below the fourth weakened region 766.

As noted above, the attachment holes 750 receive a fastener 52 (shown in FIG. 1). This fastener 52 secures the first leg 740*a* to the first sloping side 36 of the roof ridge 35. An additional fastener 52 may also secure the second leg 740*b* to the second sloping side 38 of the roof ridge 35. (The first sloping side 36, the roof ridge 35, and the second sloping side 38 are all shown in FIG. 1).

Positioning of the attachment holes 750 below each of the weakened regions 760, 762, 764, 766 provides significant benefits. Specifically, in this configuration, the ridge riser 710 more securely retains a roof during a wind storm. The roof is much less likely to be blown upwards—away from the remainder of the building. This improved ability to secure a roof during a wind storm is especially important in areas that frequently experience, for example, hurricanes or tornadoes.

Aligning each of the two holes 750 (relative to the transverse axis 19) below each weakened region 760, as illustrated in FIG. 11, can further provide a significant benefit. In particular, in such a configuration, each of the fasteners 52 positioned within the holes 750 will likely bear an equal or substantially equal weight if an upward force is applied to an attached roof. Notwithstanding this benefit, the disclosed invention may also encompass the use of attachment holes 750 under each weakened region 760 that are offset relative to each other.

Figure 12A:
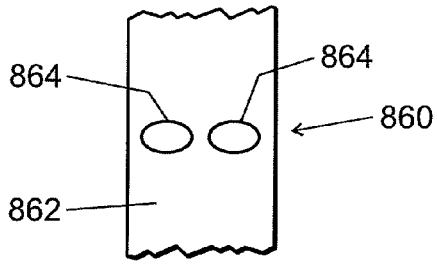
FIGS. 12A through 12C show perspective views of various embodiments of weakened regions that may be used in any of the embodiments of the ridge risers described herein.
Figure 12B:
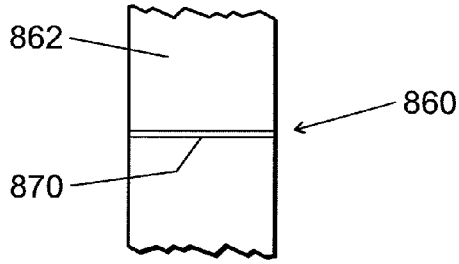
Figure 12C:
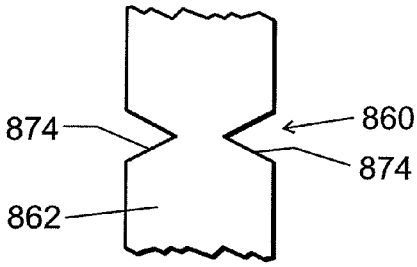

Referring now to FIGS. 12A, 12B, and 12C, alternative embodiments of a weakened region 860 are illustrated. The weakened regions 860 shown in FIGS. 12A through 12C may be used as one or more of the weakened regions 760, 762, 764, 766 described above. The weakened regions 860 may also replace one or more of the scores or score lines discussed in the embodiments illustrated in FIGS. 1-10. Thus, the weakened region 860 is an alternative to the weakened regions/score lines used in the embodiments discussed above. In the embodiment of FIG. 12A, the weakened region 860 comprises two openings 864 in a strip of metal 862. These openings 864 may be punched out of the strip of metal 862 during the stamping process. In some embodiments, the openings 864 may be aligned (i.e., positioned at the same vertical location on the leg) so that, when the user bends the leg at the weakened region 860, a linear or substantially linear bend is created (that may or may not be perpendicular to the axis 18 (shown in FIG. 11) of the leg). The shape and number of the openings 864 may also be varied within the scope of this invention. For example, a series of tiny openings 864 could constitute another type of weakened region.

In FIG. 12B, the weakened region 860 comprises a single score 870 that spans across the entire width of the strip of metal 862. This score 870 may be stamped or pressed onto the strip of metal 862, or may be made using a variety of other techniques. In one embodiment, this single score 870 is very shallow to avoid undermining the strength of the ridge riser 710 when the weakened region 860 is bent.

In FIG. 12C, the weakened region comprises two notches 874 that are removed from the strip of metal 862. In further embodiments, more than two notches 874 may also be used. Less than two notches 874 are also possible in other embodiments. These notches 874 may be removed from the edges of the strip of metal 862. The notches 874 may be aligned or may be offset, as desired. As with the other embodiments, the two notches 874 may create linear bend that may or may not be perpendicular to axis 18.

It should be noted that all of the weakened regions 860 shown in FIGS. 12A through 12C may be designed such that a user can bend the legs 740, at the weakened region 860, by hand—i.e., without the use of tools. Other types of configurations for the weakened region 860 may also be used. For example, different types of weakened regions 860 may be combined or utilized on a single leg 740 or ridge riser 710.

Referring now to FIG. 13, a further embodiment of a ridge riser 910 is illustrated. The ridge riser 910 is similar to the embodiments discussed above. In fact, the ridge riser 910 is patterned after the ridge riser 710 shown in FIG. 11. Accordingly, the features, elements, and discussions given above in conjunction with FIG. 11 may apply equally to the ridge riser 910.

The ridge riser 910 includes two legs 940 having weakened regions 960, 962, 964, 966. In the embodiment of FIG. 13, four weakened regions 960, 962, 964, 966 are shown. However, further embodiments may be designed in which more or less than four weakened regions 960, 962, 964, 966 are utilized. Attachment holes 950 may also be added and positioned below each of the weakened regions 960, 962, 964, 966. The attachment holes are designed to receive fasteners (not shown in FIG. 13) to secure the first leg to the first sloping side (shown in FIG. 1) of the roof ridge (shown in FIG. 1) and the second leg to the second sloping side (shown in FIG. 1) of the roof ridge (shown in FIG. 1).

However, the ridge riser 910 differs from the ridge riser 710 in that the ridge riser 910 has a cradle 942 that has an "inverted" U-shape. This shape may be referred to as a "downward U-shape." In these embodiments, this inverted U-shaped cradle 942 is designed to support and receive an attachment block 34 (shown in phantom). Because the cradle 942 has an inverted U-shape, the floor 944 of the cradle 942 is positioned over the attachment block 34 when the attachment block 34 is secured within the cradle 942.

The cradle 942 may also be designed to include one or more sidewalls 946. However, these side walls 946 may be simply a portion of the legs 940. A block attachment hole 954 is also added. This attachment hole 954 is used to fix the attachment block 34 in place within the cradle 942. Fasteners 56 (not shown in FIG. 13) may be inserted through the block attachment holes 954 and secured within the attachment block 34 to prevent withdrawal of the attachment block 34 from the cradle 942. Once the fasteners 56 are positioned, the attachment block 34 will be supported and received by the cradle 942. Positioning of the attachment block 34 in the cradle 942 may restrict movement of the attachment block 34 in the lateral direction 16. If desired, the block attachment holes 954 of each ridge riser 910 may be offset slightly from each other in the transverse direction 18 (shown in FIG. 11), or in the direction of the longitudinal axis 14 (shown in FIG.

11), to reduce the probability that the fasteners 56 will interfere with each other within the attachment block 34. Additionally, facing holes 980 may be cut into the side walls 946 of the cradle 942. As explained above, the facing holes 980 will align with the block attachment holes 954 to permit insertion of the fasteners 56 through the side walls 946. The facing holes 980 may be made somewhat larger than the block attachment holes 954 to ensure that no portion of the side walls 946 impedes passage of the fasteners 56 into the attachment block 34.

As used herein, the term "bendable by hand without the use of tools" means that an average adult male may bend the referenced region (such as one of the weakened regions 960, 962, 964, 966 of one of the legs 940) by the use of his hands without the need to utilize any tools to cause the region to bend. The use of a weakened region 960, 962, 964, 966 that is bendable by hand without the use of tools provides a significant advantage in that a person installing the ridge riser 910 does not need to carry bending tools on the pertinent roof or leave the roof to go to bending tools in order to bend the legs 940 of ridge riser 910 to the appropriate height.

Many alternative embodiments would also provide the structural rigidity necessary to enable a ridge riser to serve as an anchor for a restraint assembly. Gussets, locking tabs, or the like may be used.

According to other alternative embodiments, ridge risers disclosed herein may be used in conjunction with a metal frame roof. Such a roof may have a plurality of I-beams that form trusses in place of wooden rafters. Purlins may then run horizontally between the trusses. A B-deck that takes the form of corrugated steel and a layer of insulation may be disposed over the I-beams and purlins. With such a roofing configuration, ridge risers may be attached directly to the I-beams, and may extend upward through the insulation. The ridge risers may be attached through the use of bolts, welding, or any other suitable attachment mechanism. Ridge risers with comparatively longer legs may be used to elevate the ridge structure over the insulation.

Use of ridge risers, according to the invention, with such a metal frame roof provides a number of advantages. It may provide more secure attachment of ridge elements because they can be supported by the metal frame rather than by the B-deck. Furthermore, use of a metal ridge riser may help to maintain the fire rating of the metal frame roof by avoiding the use of extra wooden parts to support the ridge elements.

The embodiments disclosed herein may be combined or further modified in a wide variety of ways to suit individual roofing situations. Such modifications, as would be known to one of skill in the art with the aid of this disclosure, are to be embraced within the scope of the invention.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A ridge riser for supporting an attachment block at a roof ridge, the ridge riser comprising:

a first leg for attachment to the first sloping side of a roof ridge;

a second leg for attachment to a second sloping side of the roof ridge; and a U-shaped cradle, wherein the first leg, the second leg, and the U-shaped cradle are formed of a single strip of metal, the U-shaped cradle comprising a floor and a first side wall and a second side wall, wherein a first bend is intermediate the first leg and the first side wall, a second bend is intermediate the first side wall and the floor, a third bend is intermediate the floor and the second side wall, and a fourth bend is intermediate the second side wall and the second leg, wherein the second bend and the third bend are each approximately 90 degrees and the first bend and the fourth bend are each approximately 360 degrees such that the first leg is substantially parallel to the first side wall and the second leg is substantially parallel to the second side wall when the ridge riser is in a default position;

wherein each of the first and second legs includes at least three weakened regions such that the first and second legs can be bent at one of the weakened regions to set the ridge riser at one of a set of heights relative to the ridge, wherein at least one of the weakened regions comprises two discontinuous scores that are generally collinear, wherein each of the two scores are substantially perpendicular to a transverse axis of the ridge riser, and wherein the first leg and the second leg further comprise a set of two or more attachment holes positioned below each weakened region when the ridge riser is in the default position with the ridge riser oriented such that the U-shaped cradle is positioned higher than the weakened regions, and wherein at least two of the attachment holes are positioned intermediate and spaced away from two adjacent weakened regions on the first leg along a transverse direction of the ridge riser.

2. The ridge riser of claim 1, wherein at least one of the weakened regions is bendable by hand without the use of tools.

3. The ridge riser of claim 1, wherein the set of heights includes heights to accommodate a low profile tile, a medium profile tile, and a high profile tile.

4. The ridge riser of claim 1, wherein a distance between a bottom of the cradle and a first weakened region of the at least three weakened regions is approximately 1 1/16 of an inch, a distance between the first weakened region and a second weakened region of the at least three weakened regions is approximately 1 3/16 inches, a distance between the second weakened region and a third weakened region is approximately 1½ inches when the ridge riser is in the default position.

5. The ridge riser of claim 4, further comprising a fourth weakened region on each leg, wherein a distance between the third weakened region and the fourth weakened region is approximately 1¼ inches.

6. The ridge riser of claim 1, wherein each of the first and second legs includes at least four weakened regions.

7. The ridge riser of claim 1, wherein the weakened regions on the first and second leg are symmetrical.

8. The ridge riser of claim 1, wherein each of the weakened regions facilitates a bend that is substantially linear and substantially perpendicular to the transverse axis of the ridge riser.

9. The ridge riser of claim 1, wherein at least one of the weakened regions comprises a punched out portion of the strip of metal.

10. The ridge riser of claim 1, wherein at least one of the weakened regions comprises a score that spans across an entire width of the strip of metal.

11. The ridge riser of claim 1, wherein at least one of the weakened regions comprises two notches.

12. The ridge riser of claim 1, wherein the strip of metal has a substantially uniform longitudinal width.

13. The ridge riser of claim 12, wherein the substantially uniform longitudinal width is less than six inches.

14. The ridge riser of claim 1, wherein each side wall defines a hole for receiving a fastener to secure the attachment block within the cradle.

15. The ridge riser of claim 14, wherein the holes for receiving each fastener are offset relative to each other.

16. A ridge riser for supporting an attachment block at a roof ridge, the ridge riser comprising:

a first leg for attachment to a first sloping side of the roof ridge;

a second leg for attachment to a second sloping side of the roof ridge; and a U-shaped cradle, wherein the first leg, the second leg, and the U-shaped cradle are formed of a single strip of metal, wherein each of the first and second legs includes at least three weakened regions such that the first and second legs can be bent at one of the weakened regions to set the ridge riser at one of a set of heights relative to the ridge, wherein at least one of the weakened regions comprises two discontinuous scores that are generally collinear, wherein each of the two scores are substantially perpendicular to a transverse axis of the ridge riser, wherein the first leg further comprises two or more attachment holes positioned intermediate and spaced away from two adjacent weakened regions on the first leg along a transverse direction of the ridge riser, and wherein the U-shaped cradle comprises a floor and a first side wall and a second side wall, wherein a first bend is intermediate the first leg and the first side wall, a second bend is intermediate the first side wall and the floor, a third bend is intermediate the floor and the second side wall, and a fourth bend is intermediate the second side wall and the second leg, wherein the second bend and the third bend are each approximately 90 degrees and the first bend and the fourth bend are each approximately 360 degrees such that the first leg is substantially parallel to the first side wall and the second leg is substantially parallel to the second side wall when the ridge riser is in a default position, each of the first, second, third and fourth bends extending across an entire width of the strip of metal, wherein the first leg comprises a first distal end remote from the first bend and the weakened regions on the first leg are disposed intermediate the floor of the U-shaped cradle and the first distal end along the transverse direction of the ridge riser when the ridge riser is in the default position, and wherein the second leg comprises a second distal end remote from the fourth bend and the weakened regions on the second leg are disposed intermediate the floor of the U-shaped cradle and the second distal end along the transverse direction of the ridge riser when the ridge riser is in the default position.

17. The ridge riser of claim 16, wherein each of the weakened regions facilitates a bend that is substantially linear and substantially perpendicular to the transverse axis of the ridge riser.

18. The ridge riser of claim 16, wherein each of the first and second legs includes at least four weakened regions.

19. A ridge riser for supporting an attachment block at a roof ridge, the ridge riser comprising:

a first leg for attachment to a first sloping side of the roof ridge;

a second leg for attachment to a second sloping side of the roof ridge; and a U-shaped cradle, wherein the first leg, the second leg, and the cradle are formed of a single strip of material, the U-shaped cradle comprises a floor and a first side wall and a second side wall, wherein a first bend is intermediate the first leg and the first side wall, a second bend is intermediate the first side wall and the floor, a third bend is intermediate the floor and the second side wall, and a fourth bend is intermediate the second side wall and the second leg, wherein the second bend and the third bend are each approximately 90 degrees and the first bend and the fourth bend are each approximately 360 degrees such that the first leg is substantially parallel to the first side wall and the second leg is substantially parallel to the second side wall when the ridge riser is in a default position, wherein each of the first and second legs includes at least three weakened regions such that the first and second legs can be bent at one of the weakened regions to set the ridge riser at one of a set of heights relative to the ridge, wherein at least one of the weakened regions comprises two discontinuous scores that are generally collinear, wherein each of the two scores are substantially perpendicular to a transverse axis of the ridge riser, and wherein the first leg and the second leg further comprise a set of two or more attachment holes positioned proximate each weakened region for receiving fasteners to secure the first leg to the first sloping side of the roof ridge and the second leg to the second sloping side of the roof ridge, wherein at least two of the attachment holes are positioned intermediate and spaced away from two adjacent weakened regions on the first leg along a transverse direction of the ridge riser, wherein the first leg comprises a first distal end remote from the first bend and the weakened regions on the first leg are disposed intermediate the floor of the U-shaped cradle and the first distal end along the transverse direction of the ridge riser when the ridge riser is in the default position, and wherein the second leg comprises a second distal end remote from the fourth bend and the weakened regions on the second leg are disposed intermediate the floor of the U-shaped cradle and the second distal end along the transverse direction of the ridge riser when the ridge riser is in the default position.

20. The ridge riser of claim 19, wherein each of the weakened regions facilitates a bend that is substantially linear and substantially perpendicular to the transverse axis of the ridge riser.

21. The ridge riser of claim 19, wherein each of the first and second legs includes at least four weakened regions.

* * * * *